US006092356A

United States Patent [19]

Stahlecker

[11] Patent Number: 6,092,356

[45] Date of Patent: Jul. 25, 2000

[54] PROCESS AND APPARATUS FOR OPEN-END SPINNING

[75] Inventor: Fritz Stahlecker, Bad Überkingen, Germany

[73] Assignees: Fritz Stahlecker, Bad Ueberkingen; Hans Stahlecker, Suessen, both of Germany

[21] Appl. No.: 09/174,242

[22] Filed: Oct. 16, 1998

[30] Foreign Application Priority Data

Oct. 25, 1997 [DE] Germany ..... 197 47 287

[51] Int. Cl.[7] ..... D01H 4/00

[52] U.S. Cl. ..... 57/400; 57/401; 57/403

[58] Field of Search ..... 57/400, 401, 403

[56] References Cited

U.S. PATENT DOCUMENTS

| | | | |
|---|---|---|---|
| 4,222,222 | 9/1980 | Didek et al. | 57/401 |
| 4,281,507 | 8/1981 | Didek et al. | 57/401 |
| 5,187,930 | 2/1993 | Stahlecker | 57/403 |
| 5,768,879 | 6/1998 | Stahlecker | 57/401 |
| 5,890,356 | 4/1999 | Stahlecker | 57/401 |
| 5,899,056 | 5/1999 | Stahlecker et al. | 57/401 |

FOREIGN PATENT DOCUMENTS

| | | | |
|---|---|---|---|
| 1510937 | 9/1970 | Germany . | |
| 4319203A1 | 12/1994 | Germany . | |
| 2300330 | 12/1990 | Japan | 57/401 |

*Primary Examiner*—William Stryjewski
*Attorney, Agent, or Firm*—Evenson, McKeown, Edwards & Lenahan, P.L.L.C.

[57] ABSTRACT

A process for open-end spinning provides for at least one sliver being opened into single fibers. A wide fiber veil is formed from parallel single fibers extending in the direction of motion, which fiber veil is fed to a transporting surface by means of a moving collecting surface. The single fibers are transferred from the collecting surface to the transporting surface at a transfer point, whereby the direction of motion of the fiber veil is abruptly changed, however the current relative position of the single fibers remaining essentially constant. This motion direction change occurs at the transfer point, with the respective front part of the fiber veil being transferred to the transporting surface as a fiber group in a predetermined sequence, and the transporting surface moves transversely to the direction of motion of the collecting surface. The single fibers are then transported by means of the transporting surface to a spinning line, which is situated on the transporting surface and extends transversely to the direction of motion thereof and along which the forming yarn is withdrawn. Due to the sequenced transfer point and the selected directions of motion of the collecting surface and the transporting surface, the single fibers can be bound into the yarn essentially parallel to the spinning line.

51 Claims, 12 Drawing Sheets

PROCESS AND APPARATUS FOR OPEN-END SPINNING

BACKGROUND AND SUMMARY OF THE INVENTION

This application claims the priority of German application 197 47 287.7, filed in Germany on Oct. 25, 1997, the disclosure of which is expressly incorporated by reference herein.

The present invention relates to a process for open-end spinning, in which (i) at least one sliver is opened into single fibers; (ii) parallel single fibers extending in the direction of motion, form a wide fiber veil, (iii) the fiber veil is transported by means of a moving collecting surface to a transfer point, (iv) at the transfer point the single fibers are transferred from the collecting surface to a transporting surface, whereby the current position of the single fibers is essentially maintained, (v) the single fibers are transported by means of the transporting surface to a spinning line, which extends on the transporting surface transversely to its direction of motion; and (vi) the single fibers are spun into a yarn along the spinning line, which yarn is withdrawn in its longitudinal direction.

A spinning process of this type is described in U.S. Pat. No. 5,768,879. In this process, a wide fiber veil is formed from parallel fibers extending in the direction of motion, whereby the number of fibers in the fiber veil corresponds to the number of fibers later found in the yarn cross section, as long as no subsequent doubling occurs. Directly after the sliver has been opened into single fibers, that is, at a point at which the single fibers have not yet reached a high speed, the fiber veil is taken up at a controlled speed by a mechanical collecting surface. This controlled speed permits the single fibers to remain constantly stretched without any crinkling whatsoever during the entire spinning process.

The disadvantage of this known process is that the single fibers reach the spinning line in a more or less perpendicular position, so that the end of the forming yarn obtains at first a false twist, which must be reversed before a real twist is imparted. This results in yarn with an insufficient tear-resistance.

German published patent application 43 19 203 Al discloses that it is favorable when the single fibers are bound into the forming yarn to a great extent parallel to the spinning lines. In the known process this should be achieved in that single fibers, accelerated by an opening roller under the action of centrifugal forces, are accompanied in flight direction by an air current, which allegedly aligns the fibers parallel to the spinning line. It has been shown, however, that, using such pneumatic means, the fibers do not reach the spinning line in a parallel position, but rather more or less transversely thereto, so that in this process also, a larger false twist arises in the forming yarn.

German published patent application 1 510 937 discloses that the opened single fibers should be deposited on a transporting surface parallel to the spinning line. The publication is silent, however, as to how a sliver fed transversely to a transporting surface can be opened in such a way that the single fibers are disposed on the transporting surface in the desired direction.

It is an object of the present invention, based on a produced fiber veil of the above mentioned type, to feed the fibers in a controlled mechanical way to the spinning line in such a way that they extend to a great extent parallel to the spinning line, so that any modicum of false twist during yarn formation is as little as possible.

This object has been achieved in accordance with preferred embodiments of the present invention by providing that:

(a) at the transfer point the respective front part of the fiber veil is transferred as a fiber group at a predetermined sequence to the transporting surface; and (b) the transporting surface is moved transversely to the direction of motion of the collecting surface, so that the single fibers on the transporting surface are disposed transversely to the new direction of motion and thus essentially parallel to the spinning line.

Although the collecting surface as well as the transporting surface are each respectively moved at a continuous speed, the transfer of the single fibers from the collecting surface to the transporting surface takes place intermittently. The single fibers are transferred as fiber groups at regular intervals lasting a fraction of a second. This method permits each point of a single fiber to be released at the same time from the collecting surface and to reach the transporting surface. The single fibers are thus accelerated spontaneously in the new direction of motion, transverse to the old direction of motion, without the current relative angular orientation position of the single fibers being altered.

The length of the transfer point must, of course, be significantly longer than the staple length of the fibers to be spun. The sequenced transfer takes place always then, when the front part of the fiber veil, that is a fiber group, completely fills the space of the transfer point.

The speed of the transporting surface can determine the space between each of the single fibers, whereby the space should be so distinct that a purely open-end spinning arises.

In order that the single fibers adhere well to the collecting and transporting surfaces on the one hand, and on the other that this adherence can be eliminated immediately, the single fibers are held on the collecting surface and the transporting surface by means of suction.

It is favorable when, at the transfer point, the transporting surface which faces the collecting surface goes past the collecting surface while intersecting it at a small distance therefrom, whereby the sequenced fiber group to be transferred is lifted entirely from the collecting surface and disposed on the transporting surface. Plane surfaces are best suited for the collecting and transporting surfaces, for example a sieve belt or disk. Alternatively, a sieve drum would also be possible, as long as it had a sufficiently large diameter. The short distance permits a sufficiently rapid transfer, which lies in the range of milliseconds. The distance optimally measures between 3 and 4 mm. This permits a spontaneous change of direction to be set, without the relative position of the single fibers being altered, that is, the single fibers moving at first in their longitudinal direction are transported transversely to their longitudinal orientation within a fraction of a second.

It is purposeful when, during the sequenced transfer of a fiber group from the collecting surface to the transporting surface, the suction of the collecting surface in the area of the transfer point is temporarily discontinued. Thus the adherence in the area of the transfer point is abruptly and completely eliminated. The suction at the transfer point must, of course, be separate from the suction of the remaining areas of the collecting surface. The transporting surface in contrast can be continuously suctioned. The low pressure is maintained during the filling of the transfer point by a fiber group, and the low pressure is lifted for a fraction of a second, during the sequenced transfer of the single fibers from the collecting surface to the transporting surface.

In order to accelerate the transfer of the single fibers, the lifting of the fiber group from the collecting surface during the break in suction can be supported by means of compressed air.

It can be favorable when the fiber veil is already divided into fiber groups when it is being formed during opening of the sliver. Directly before the transfer point, a part of the collecting surface thus remains free of single fibers, or at least more fiber-free than in the other areas. This can be achieved by means of a controlled depositing of the single fibers on the collecting surface.

Furthermore, it is possible for the single fibers to be drawn again during the transfer of a fiber group from the collecting surface to the transporting surface. For example, the collecting surface and the transporting surface can be somewhat inclined towards each other, in such a way that the distance to the collecting surface in the direction of motion is somewhat enlarged. This ensures for certain that the fiber end reaches the transporting surface first, while the fiber head, due to its original direction of motion, still draws the relevant single fiber somewhat.

The process can be particularly easily executed if the transporting surface in the area of the spinning line is also effective in imparting a twist to the forming yarn. It is of course self-evident that a twist roller, and as desired, an air nozzle arranged downstream thereof are also effective in imparting the twist according to certain preferred embodiments.

Although it is desirable that the single fibers join the forming yarn as parallel to the spinning line as possible, it can be purposeful for the present invention when an additional false twist is imparted as a protective twist. The false twist should of course be very weak. This can be achieved by means of a slightly slantingly positioned twist roller, by means of which the arising fiber tip is strengthened, so that it cannot "hang" from the forming yarn. In any case, the false twist is removed after the yarn has left the transporting surface.

BRIEF DESCRIPTION OF THE DRAWINGS

The present invention relates also to arrangements for carrying out the process and this and further objects, features and advantages of the present invention will become more readily apparent from the following detailed description thereof when taken in conjunction with the accompanying drawings wherein.

DETAILED DESCRIPTION OF THE DRAWINGS

Figure 1:
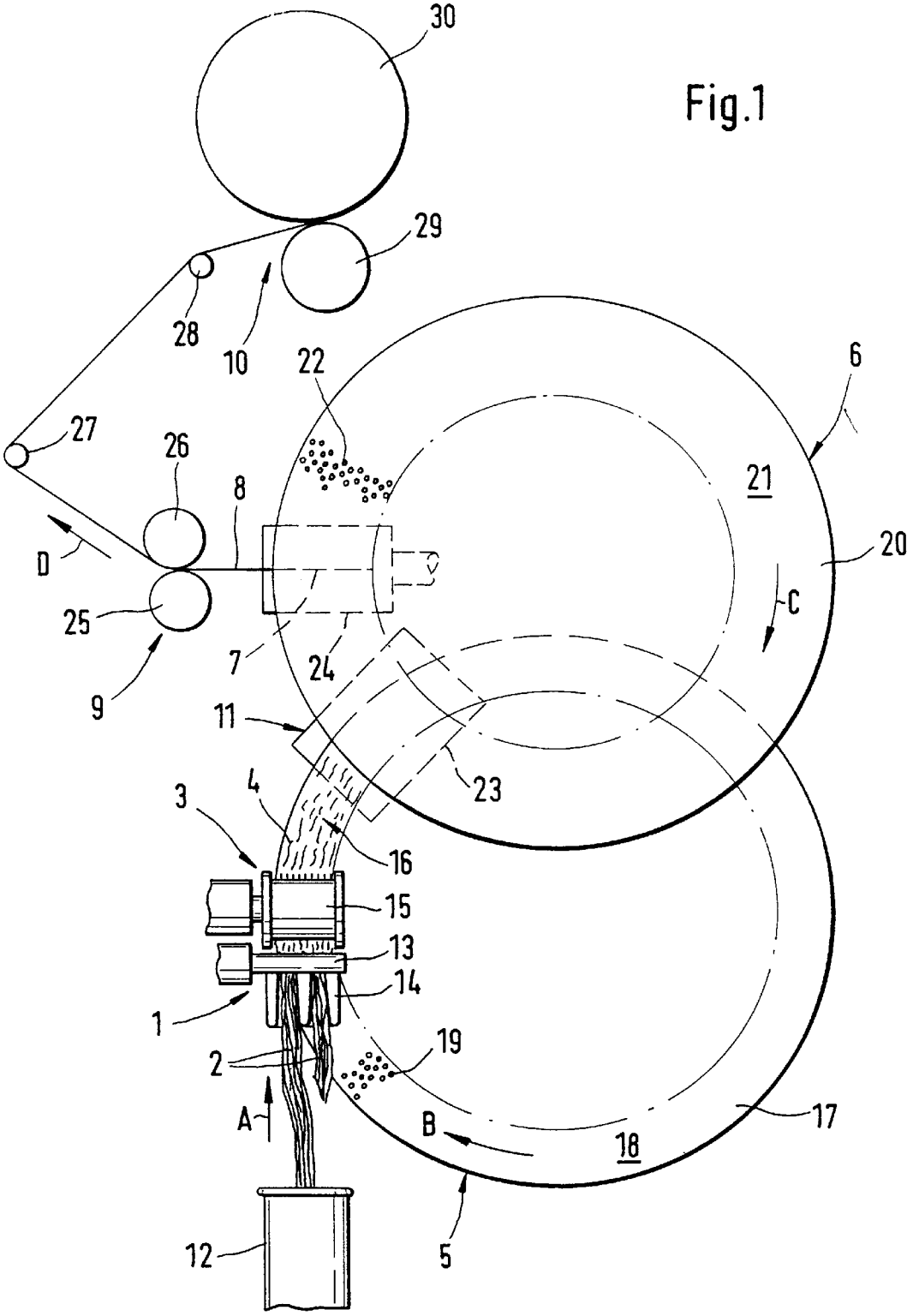
FIG. 1 is a schematic view depicting an arrangement for carrying out the spinning process according to the present invention.

In the following description and in the drawings, similar reference numbers with respective letter suffices A,B etc. have been used to differentiate generally similarly functioning but different structural features. Unless otherwise described, the description for structures with similar reference numbers without letter suffices will also apply to the corresponding numbered structure with letter suffices.

The spinning station shown in FIG. 1 comprises a feeding device 1 for slivers 2 to be spun which are fed in feed direction A, in the case of the illustrated embodiment of the present invention, for two slivers 2. An opening device 3 is arranged downstream of the feeding device 1, which opening device 3 opens the slivers 2 into single fibers 4 and deposits them onto a first transport structure 5 moving in transport direction B. The single fibers 4 are transferred from the first transport structure 5 at a transfer point 11, described in detail below, to a second transport structure 6, which moves in transport direction C. On this second transport structure 6, the single fibers 4 reach a spinning line 7, which extends transversely to the transport direction C. The yarn 8 forming along the spinning line 7 is withdrawn in direction D by a withdrawal device 9 and fed to a winding device 10.

The transfer point 11, described in more detail below, at which the single fibers 4 are transferred from the first transport structure 5 to the second transport structure 6 without changing their current relative angular orientation position, is an important aspect of certain preferred embodiments of the present invention.

The slivers 2 to be spun are disposed in sliver cans 12. The feeding device 1 comprises a correspondingly wide feed roller 13 for the number of slivers 2, which feed roller 13 acts together with a sliver guide 14 arranged upstream therefrom.

An opening roller 15 of the opening device 3 opens the slivers 2 to single fibers 4 and deposits the single fibers 4 in the form of a fiber veil 16 onto the first transport structure 5. The fiber veil 16 has a width corresponding to the width of the feed roller 13 and the opening roller 15, and consists of parallel single fibers 4, which are drawn in the direction of motion, that is, in transport direction B. This fiber veil 16 is thus, immediately after the opening of the sliver 2, transported as single fibers at a defined speed, whereby the fiber veil 16 is homogeneous also in cross direction.

The first transport structure 5 in the embodiment described here is in the -form of a transport disk 17, which comprises a ring-shaped collecting surface 18 in the area of its outer diameter, which collecting surface 18 is provided with a perforation 19. The ring-shaped collecting surface 18 is shown by a dot-dash area and connected to a suction device which is described below.

FIG. 1 is a view looking down from above onto the collecting surface 18.

The second transport structure 6 is also in the form of a transport disk 20, which is provided on the area of its outer diameter with a transporting surface 21. Tne transporting surface 21, also denoted by a dot-dash circle and connected to a suction by a perforation pattern 22, is disposed at a small distance with respect to the collecting surface 18, and is therefore not visible in FIG. 1. The relationship of the collecting surface 18 and the transporting surface 21 to each other is described below in more detail with the aid of further Figures.

At the above mentioned transfer point 11, a specially designed transfer station 23 is located, which is a switching station and described in detail below. Its purpose is to permit the single fibers 4 to be transferred from the collecting surface 18 to the transporting surface 21 without altering their current relative angular orientation position. This means that the single fibers 4 on the collecting surface 18 are directed in transport direction B, whereas they are to be disposed on the transporting surface 21 transversely to the transport direction C. The point of this measure is that the single fibers 4 are orientated in a direction which corresponds to a great extent to the direction of the spinning line 7.

The spinning line 7 is laid down by the transporting surface 21 as well as by means of a twist roller 24, which takes the form of a friction roller and comprises a perforated surface connected to suction. The yarn 8 is formed along the spinning line 7, whereby the fiber tip is continuously renewed by means of the feed of single fibers 4.

The withdrawal device 9 comprises a pair of delivery rollers 25,26, of which at least one is driven. By means of two deflecting yarn guides 27 and 28, the yarn 8 reaches a package 30, which is placed on a winding roller 29 during operation and driven by means thereof.

As the transport disks 17 and 20 are placed edgeways, this results in a very narrow spinning station, in which spinning is carried out from below upwards. As can be seen, the transporting surface 21 is wider than the collecting surface 18. The width of the transporting surface 21 should correspond to the required length of the spinning line 7. The collecting surface 18 in contrast need only be so wide that it can take up the fiber veil 16. It should be mentioned that the opening roller 15 as well as the twisting roller 24 may both be slightly conical in shape, corresponding to the diameter change of the collecting surface 18 and the transporting surface 21.

Figure 2:
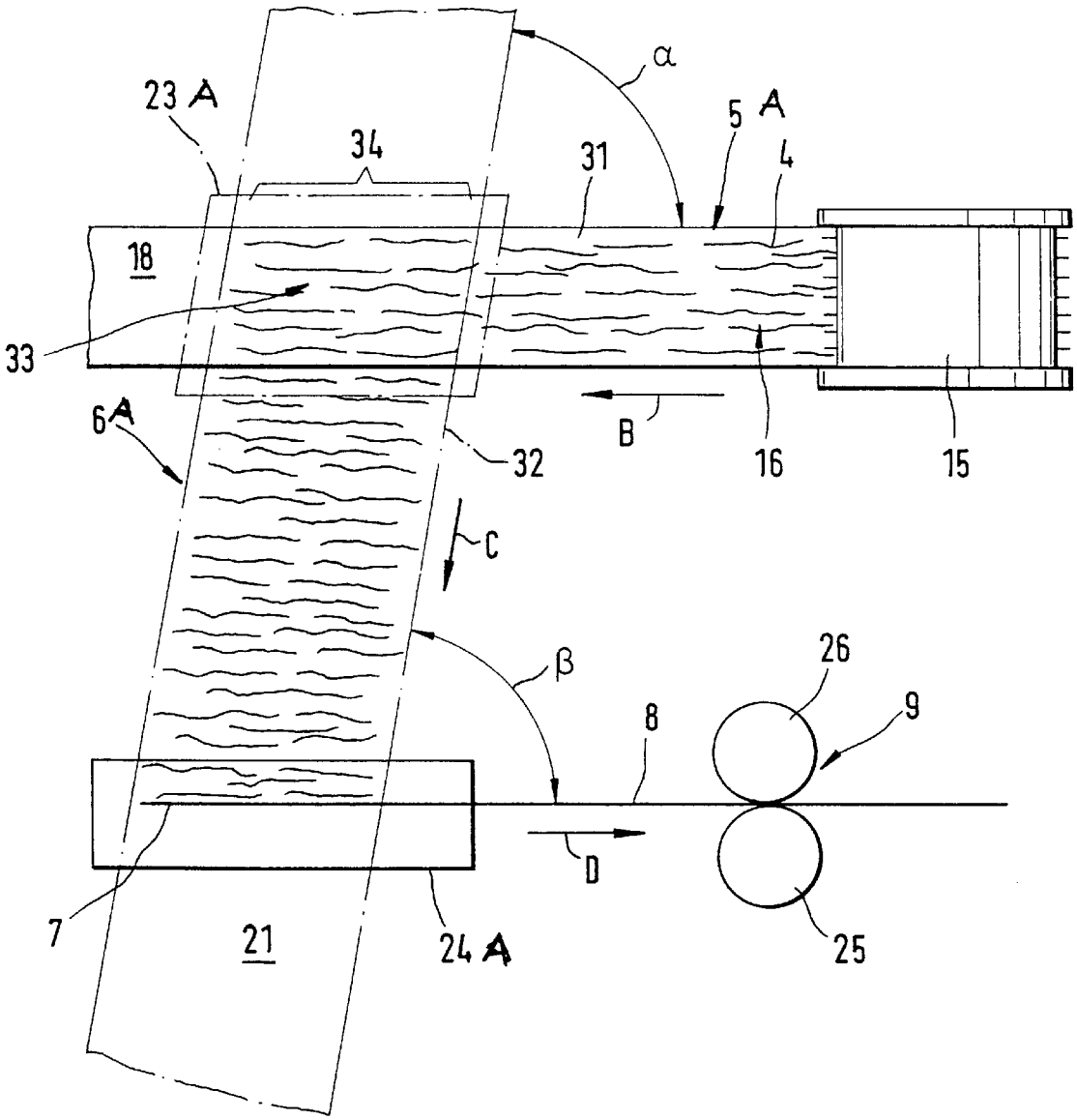
FIG. 2 is a schematic view of the arrangement of FIG. 1, showing an area of a transfer point from a collecting surface to a transporting surface for the purpose of describing the actual concept of the invention.

FIG. 2 demonstrates the principle functions of the transfer station 23, which is denoted in this schematic drawing by a dot-dash rhombus.

Although as shown in FIG. 1, the present invention can be realized in an advantageous way by the transport disks 17 and 20, for reasons of simple representation in FIG. 2, the first transport structure 5A is shown as a transport belt 31 in the form of a sieve belt and the second transport structure 6A is shown as a transport belt 32 also in the form of a sieve belt. As the already described transporting surface 21 faces the collecting surface 18, that is, invisible to the viewer of FIG. 2, the transport structure 6A is only denoted by means of dot-dash lines, so that the single fibers 4 to be deposited on the transporting surface 21 need not be drawn in broken lines.

An opening roller 15 is shown, which deposits the opened single fibers 4 in the form of a fiber veil 16 onto the collecting surface 18 which transports the fiber veil 16 in the direction towards the transfer station 23. Furthermore, the twist roller 24A can be seen, which together with the transport belt 32, defines the spinning line 7, which the single fibers 4 reach in transport direction C. The forming yarn 8 is withdrawn in withdrawal direction D by the withdrawal device 9 which comprises the delivery rollers 25 and 26.

In order to keep the representation as general as possible, the crossover angle $\alpha$ between the transport belts 31 and 32 in the area of the transfer station 23A is drawn as an acute angle. Correspondingly, between the transport direction C of the second transport means 6 and the withdrawal direction D, a further acute angle $\beta$ is drawn. The angle $\alpha$ and $\beta$ need not be the same size. The angle $\beta$ in particular defines the relative position of the spinning line 7 to the transport direction C and influences whether in the spinning line 7, more or less tension should be generated in the forming yarn 8. In practice, it is of course easiest to choose the crossover angle $\alpha$ and the angle $\beta$ both at 90°.

As already mentioned, the drawn transport belts 31 and 32 serve primarily to simplify representation; they could therefore be replaced by the transport disks 17 and 20.

As already mentioned, it is the purpose of the transfer station 23A to change the transport direction B of the fiber veil 16 into a transport direction C, whereby the current relative angular orientation position of the single fibers 4 is to be maintained. The single fibers 4 therefore change transport direction, but do not change their angular orientation.

As soon as the front part 33 of the fiber veil 16 disposed on the collecting surface 18 at the transfer station 23A reaches under the transporting surface 21, this front part 33 is taken over completely by the transporting surface 21 as a fiber group 34. For this, as described below with the aid of FIG. 3, the suction of the collecting surface 18 in the area of the transfer station 23A is temporarily stopped, so that only the suction of the transporting surface 21 acts on the fiber group 34. The single fibers 4 are then disposed from below onto the transporting surface 21 which runs at a close distance to the collecting surface 18. The suction of the transporting surface 21 is continuously present at the transfer station 23A.

The suction of the collecting surface 18 at the transfer station 23 functions therefore intermittently. It remains in operation until sufficient single fibers 4 of the fiber veil 16 are again transported to the transfer station 23A. Then the suction of the collecting surface 18 is stopped at the transfer station 23A for a short time, and the single fibers 4 abruptly reach the transporting surface 21. Immediately thereafter, the suction of the collecting surface 18 is switched on again, in order that a new fiber group 34 in the form of a front part 33 of the fiber veil 16 can be fed to the transfer station 23A.

The transfer always takes place then when a new fiber group 34, as shown in FIG. 2, has filled the space under the transporting surface 21. The single fibers 4 jump from the collecting surface 18 to the underside of the transporting surface 21 disposed thereabove. This happens in a fraction of a second.

During this transfer of the single fibers 4, the filling of the space in the transfer station 23A with the single fibers 4 continuously fed in transport direction B takes place. Although the transfer itself takes place intermittently, the transport structures 5A and 6A operate continuously, that is, they are not sequenced.

Thanks to the new transport direction C, the single fibers 4 reach the spinning line 7 to a large extent parallel thereto, that is, they are bound into the forming yarn 8 extensively with real twist. If the single fibers 4 did not reach the spinning line 7 parallel thereto, than a false twist would first arise, which is in the opposite direction to the desired real twist.

As can be seen, also in the example in FIG. 2, the collecting surface 18 is narrower than the transporting surface 21. The width of the transporting surface 21 must namely be in any case significantly larger than the staple length of the single fibers 4 to be spun. For the width of the collecting surface 18 in contrast, it is sufficient when enough single fibers 4 of the fiber veil 16 are taken up beside one another as required for the cross section of the forming yarn 8.

It is also important that the single fibers 4 arriving parallel to the spinning line 7 have a large enough distance in transport direction C to one another, which distance should be large enough so that one can speak of an "open end". Only then is it possible to generate a real twist in the forming yarn 8. The quicker the second transport structure 6A is, in comparison to the speed of the first transport structure 5A, the larger is the distance of the single fibers 4 to one another.

If the single fibers 4 arrive at the spinning line 7 slanted at a very small angle by means of the slanted position of the twist roller 24A, this can result in a very small consolidation of the direct fiber tip. A very low false twist in then taken into consideration, in order that when the yarn 8 is being withdrawn, the fiber tip cannot "hang off". A slight false twist, which can be removed again after the fibers have left the spinning line 7, can, in fact, be of use.

Figure 3:
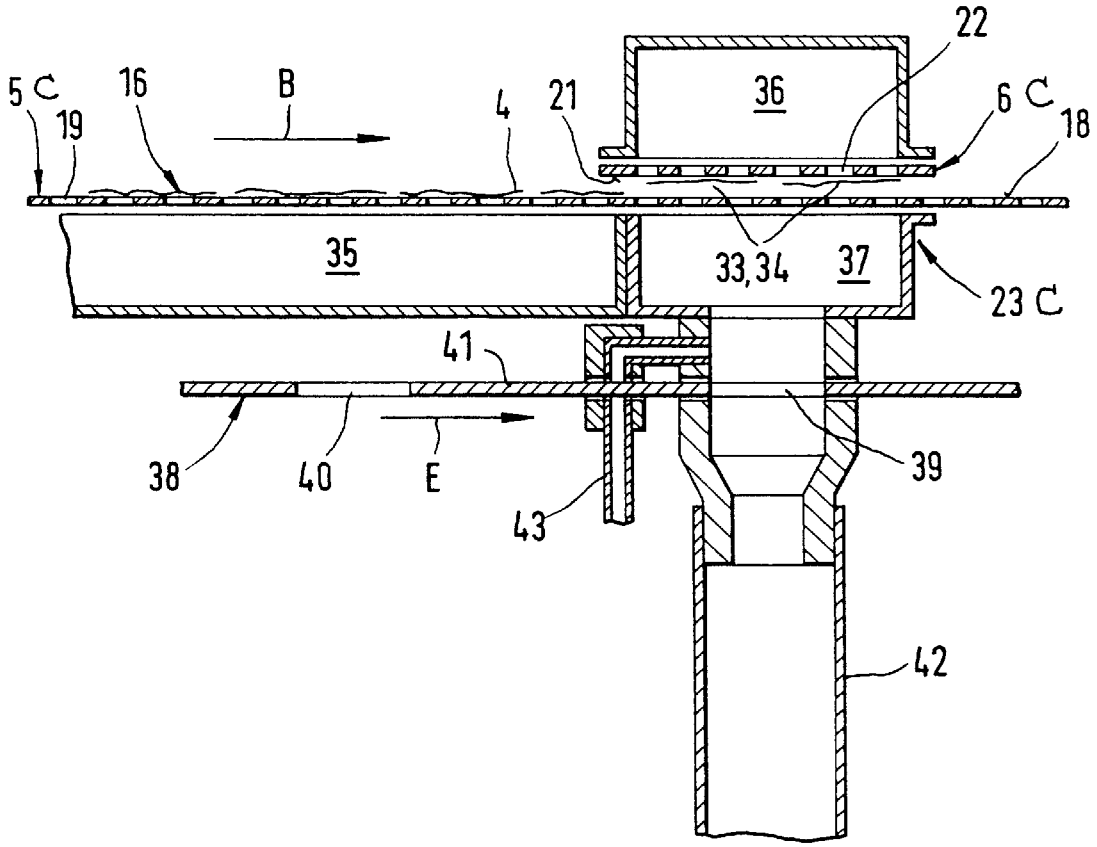
FIG. 3 is a schematic view which shows the apparatus for providing intermittent suction at the transfer point of the arrangement of FIGS. 1 and 2.

With the aid of FIG. 3, the embodiment of a transfer station 23A is explained, whereby both transport structures 5C and 6C, for reasons of simplification, are shown again as transport belts. It should be mentioned here, however, that transport disks could also be used to advantage.

According to FIG. 3, the single fibers 4 move in the form of a fiber veil 16 disposed on the collecting surface 18 in transport direction B to the transfer station 23C. Transversely thereto, that is, coming out from the drawing level, the second transport surface 6 is disposed, whose transporting surface 21 lies at a close distance from the collecting surface 18. It can be seen that the collecting surface 18 faces the transporting surface 21. The perforations 19 and 22 of the two transport structures 5C and 6C are likewise visible.

Both transport structures 5C and 6C are suctioned. Outside of the transfer station 23C, a suction device 35 is arranged at the collecting surface 18, which suction device is always active. Inside the transfer station 23C, there is a separate suction chamber 37 for the collecting surface 18, said suction chamber 37 being independent of the suction device 35 and functioning intermittently. Again, the suction device 36 arranged to the transporting surface 21 is continuously active.

Whenever a front part 33 of the fiber veil 16 inside the transfer station 23C reaches under the transporting surface 21, the suction of the suction chamber 37 is automatically stopped, but only for a fraction of a second. This time span is sufficient to transfer the fiber group 34 located in the transfer station 23 spontaneously to the transporting surface 21, without the current position of the single fibers 4 being altered. The single fibers 4 simultaneously reach the transporting surface 21 from the collecting surface 18 in their entire length.

Control of the suction chamber 37 occurs in this example by means of moving a steel belt 38 in travel direction E. It is expressly mentioned at this point that this type of valve for controlling the intermittently functioning suction chamber 37 is simply an embodiment according to the present invention, for which there are a plurality of alternatives.

The steel belt 38 comprises at a certain distance to one another the openings 39 and 40 as well as areas 41 without openings. The distance between the openings 39 and 40 corresponds to the length of the transfer station 23, that is, the width of the second transport structure 6C. Whenever the suction of the suction chamber 37 is to be stopped, the steel belt 38 closes off the suction chamber 37. The suction chamber 37 is connected by means of a flexible pipe 42 with a vacuum source (not shown).

Every time when the transfer of the single fibers 4 from the collecting surface 18 to the transporting surface 21 is to take place, additional compressed air can be blown into the upper area of the suction chamber 37, as shown by the compressed air piping 43. This compressed air piping 43 can also be sequenced by means of the steel belt 38. Whenever the suction chamber 37 is closed off by means of the steel belt 38, that is, when the low pressure in the suction chamber 37 is lifted for a short period, compressed air, controlled by means of the steel belt 38, is blown into the suction chamber 37. The transfer of the fiber group 34 from the collecting surface 18 to the transporting surface 21 can, in as far as it is desired, be supported thereby.

As mentioned above, the suction device 36 of the transporting surface 21 is continuously active. The fiber group 34, which enters the transfer station 23C, is not disturbed by this, as it is held securely by means of low pressure on the collecting surface 18 while it is moving. The single fibers 4 on the collecting surface 18 are much nearer to the vacuum source of this transport structure 5C than to the vacuum source of the other transport structure 6C.

It is also contemplated to stop the suction of the suction-device 36 when the fiber group 34 is entering the transfer station 23C, and to apply it again only when a fiber group 34 has completely entered the transfer station 23C.

By means of the sequenced switching on and off of the suction chamber 37, the entire fiber group 34 jumps inside the transfer station 23C spontaneously upwards from the collecting surface 18 to the underside of the transporting surface 21. The single fibers 4 maintain their current alignment, whereby they were beforehand directed in transport direction B on the collecting surface 18 and now lie on the transporting surface 21 transverse to the new transport direction C. The single fibers 4 are thus aligned more or less parallel to the spinning line 7.

The duration of the transfer of a fiber group 34 is negligibly short. When the fibers enter into the transfer station 23, there is a short break-off during the transfer, so that the next fiber batch can enter into the transfer station 23C.

Although the suction chamber 37 functions pulsatingly or intermittently, it is not necessary to stop one of the two transport structures 5C or 6C for a short time. As a result of the high transfer speed, the collecting surface 18 as well as the transporting surface 21 can travel through without stopping.

A significant feature of the transfer station 23C is that two transport surfaces 5C and 6C are disposed more or less crosswise over one another and that the single fibers 4, seen in transport direction B, are disposed in a drawn state on the collecting surface 18, and that they are taken over in such a way at the crossover point by means of the transporting surface 21 that the single fibers 4 are disposed more or less transversely to the new transport direction C.

The single fibers 4 are held by means of low pressure on the collecting surface 18 and the transporting surface 21, which are both perforated. During the transfer of the single fibers 4 inside the transfer station 23C, the adherence of the single fibers 4 is lifted, whereby it is purposeful when the collecting surface 18 and the transporting surface 21 are brought closely together, so that the path of a fiber group 34 from the upper side of the collecting surface 18 to the underside of the transporting surface 21 is as short as possible. The aim of this transfer is to arrange the single fibers 4 on the transporting surface 21 in such a way that they facilitate the formation of the yarn 8. The fiber tip of the forming yarn 8 shall be able to rotate on the spinning line 7, without depositing single fibers 4 wrapping the yarn core. The open end should be sufficiently open to prevent false twist in the opposite direction.

As mentioned above, the control of the suction chamber 37 by means of the steel belt 38 is simply one embodiment according to the present invention. There are enough possible alternatives, of which a few are mentioned below.

In the case of one variation it is possible to provide in the suction chamber 37 a rotating star valve, which is profiled in such a way that according to whatever position it takes, the vacuum source is blocked off or is active. A further possibility is to control the suction chamber 37 by means of displacing a sliding valve. Further, electrically controlled valves are also possible. Another variation would be to control the transfer station 23C entirely by means of a cam shaft.

Figure 4:
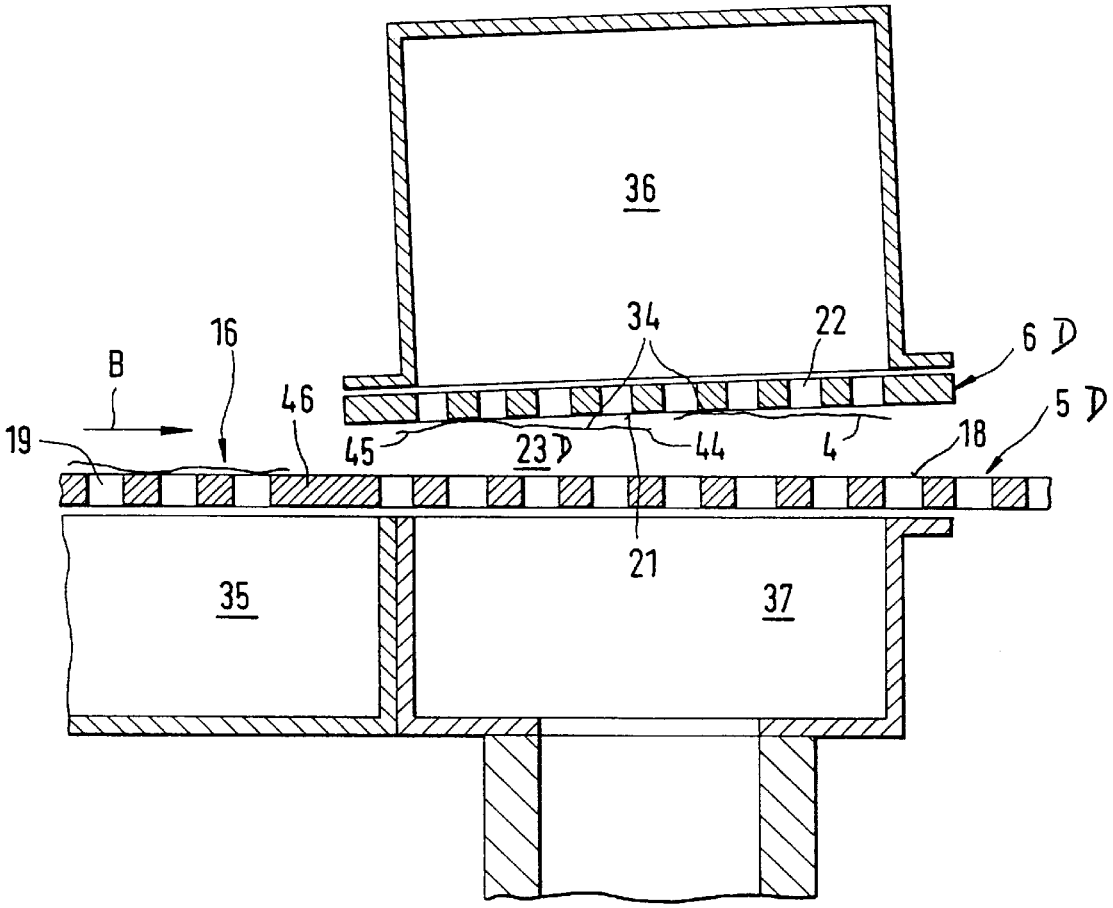
FIG. 4 is an enlarged representation of the transfer point of FIG. 3 with one altered detail.

FIG. 4 shows the area of the transfer station 23 in enlarged form and having a slight difference from the embodiments described above. The first transport structure SD is again to be seen fed in transport direction B, across which the second transport structure 6D extends. The single fibers 4 are fed in transport direction B in the form of a fiber veil 16 to the transfer station 23D and from there are, in the form of a fiber group 34, transferred at regular intervals to the transporting surface 21. There are again the two suction devices 35 and 36 for the two transport structures 5D and 6D as well as the intermittently active suction chamber 37 inside the transfer station 23D.

What is particular to the embodiment of the present invention as shown in FIG. 4 is that the transporting surface 21 is slightly inclined in relation to the collecting surface 18, whereby the narrow gap between the collecting surface 18 and the transporting surface 21 widens slightly in transport direction B. The effect of this is that the single fibers 4 of a fiber group 34 are slightly drawn during the transfer stage.

As can be seen, the ends 45 of the single fibers 4 have at the moment of transfer a shorter path than the heads 44. They therefore reach the transporting surface 21 a fraction of a second earlier. Due to the kinetic energy which a single fiber 4 receives from the collecting surface 18, the head 44 strives to move on in the old transport direction B, which, at a speed of for example 6 m per second is quite noticeable. The single fiber 4 is thus drawn. What must, however, be taken into consideration is the fact that at the end 45 of the single fiber 4, the traverse movement begins just a little sooner than at the head 44. This can be countered by means of the above mentioned crossover angle $\alpha$ of the two transport structure 5D and 6D.

In the embodiment according to FIG. 4, there is a further special feature in that the perforation 19 of the first transport structure 5D is interrupted by non-perforated cross-stripes 46. The control system is such that when the low pressure in the suction chamber 37 is stopped for a short time, a cross-stripe 46 arrives at the transfer station 23. Naturally, less single fibers 4 are located on this cross-stripe 46 than in the suctioned areas. The number of so-called bridge fibers is reduced in this way, some of which would otherwise project into the transfer station 23D and some of which would otherwise be disposed on the outside thereof, and which then would take up an undesirable position. Thanks to the cross-stripes 46, the number of undesirable bridge fibers is so small, that they are hardly noticeable as a fault.

Figure 5:
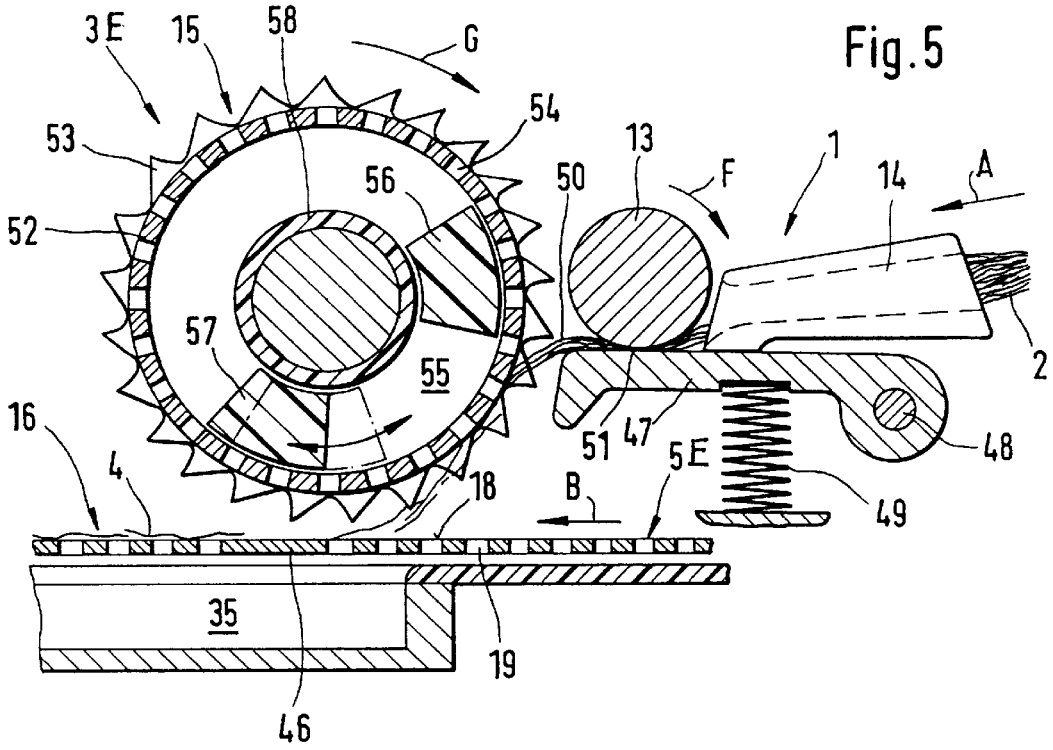
FIG. 5 is an enlarged part sectional view of the area of the opening device of the arrangement of FIGS. 1–3.

FIG. 5 shows the area of the opening device 3, where the opening roller 15 opens the single fibers 4 from the slivers 2 and transfers them in the form of a fiber veil 16 to the collecting surface 18 of the first transport structure 5E. The suction device 35 of the transport structure 5E moving in transport direction B can be clearly seen.

A feed roller 13 rotating in direction F is arranged upstream of the opening roller 15, with which feed roller 13 a feed table 47 acts in a known way, which can be swivelled around a swivel axle 48 and which can be pressed against the feed roller 13 under the action of a load spring 49. Thus a nipping line 51 is formed from which the slivers 2 form a sliver end, the so-called fiber beard 50. The entry of the slivers 2 in feed direction A is controlled by the above mentioned sliver guide 14.

The opening roller 15 comprises a combing ring 52, which is provided with a plurality of combing teeth 53. As the single fibers 4 are to be transferred to the collecting surface 18 as quickly as possible after they have been opened from the slivers 2, the combing teeth 53 preferably have a negative front angle. Due to suction bore holes 54, which are located on the periphery of the combing ring 52, the fiber beard 50 is pulled in far enough for combing in the combing teeth 53. The opening roller 15, quickly rotating in direction G, then transfers the single fibers 4 to the collecting surface 18.

Between the fiber beard 50 and the transfer point of the single fibers 4, the suction bore holes 54 are suctioned by means of a vacuum chamber 55, which is defined by adjustable sealing inserts 56 and 57.

FIG. 5 also shows how it can be achieved that the cross-stripes 46 are not covered by single fibers 4. The range of the suction field of the vacuum chamber 55 is permitted to move back and forth according to the double arrow. For this purpose, the sealing insert 57 can be swivelled around a cylindrical guide 58, whereby the oscillating movements can be controlled electronically. For example, an electromagnet can be provided, which engages with an external projection of the sealing insert 57 and which causes, accordingly in sequence, a small oscillatory movement of the sealing insert 57. The frequency of the oscillatory movements is adapted to the distance between two cross-stripes 46, which in turn correspond to the length of the transfer station 23E and the width of the transporting surface 21. Thus the arrival of single fibers 4 on the collecting surface 18 can be influenced in that the suction range is moved from side to side.

Figure 6:
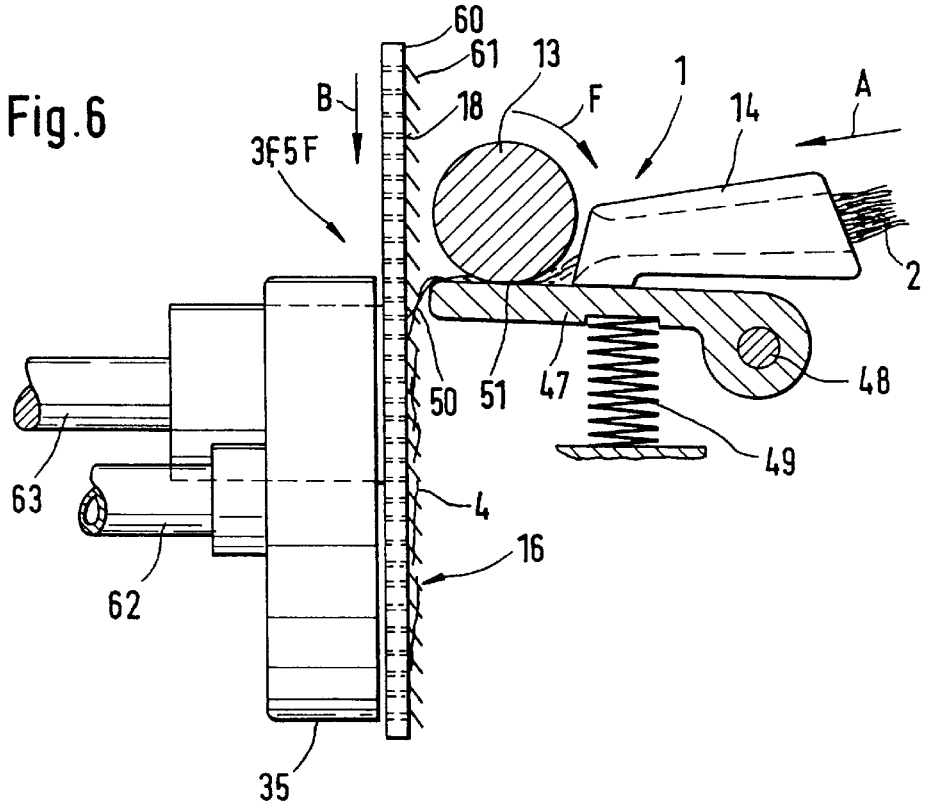
FIG. 6 is a view similar to FIG. 5, showing a different embodiment of an opening device.

A differently designed embodiment of an opening device 3F is shown in FIG. 6, whereby the feeding device 1 is designed as in FIG. 5, so that a repeat description is superfluous.

In the embodiment of the present invention according to FIG. 6, an opening disc 60 is provided instead of an opening roller 15, which at the same time forms the first transport structure 5F. The opening disc 60 is provided with needle combing structure 61. There is sufficient space between the rows of needles for the—in this case—necessary perforation.

The fiber beard 50 is sucked up against the opening disc 60 and combed out by it. At the same time, the opening disc 60 transports the combed out single fibers 4 in the form of a fiber veil 16 to the transfer station 23. There the single fibers 4 of a fiber group 34 jump out of the needle field and are disposed from above on the transporting surface 21 (not yet visible in FIG. 6). In FIG. 6, the suction device 35, together with a vacuum source 62 and the rotation axis 63 of the opening disc 60, are visible.

Figure 7:
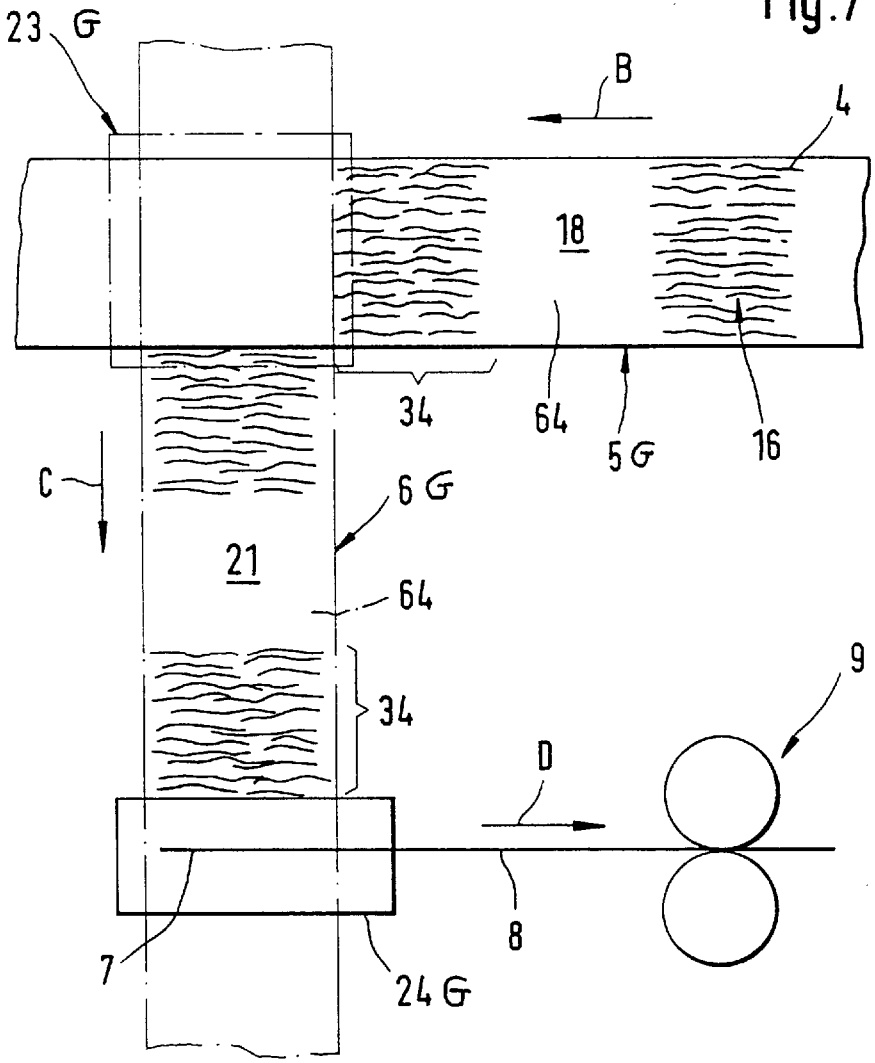
FIG. 7 is a presentation similar to FIG. 2, whereby the fiber veil i5 transported in fiber groups.

The very schematic FIG. 7 corresponds to a large extent to FIG. 2, whereby the first transport structure 5G, moving in transport direction B and containing the collecting surface 18, brings the single fibers 4 in the form of a fiber veil 16 to the transfer station 23G, where a fiber group 34 from a transporting surface 21 of the second transport structure 6G is taken over and transported in the new transport direction C to the spinning line 7. Under the co-action of a twist roller 24, the yarn 8 is produced at the spinning line 7, which yarn 8 is withdrawn in withdrawal direction D by a withdrawal device 9.

What is interesting in FIG. 7 is the group transport of the single fibers 4, so that the fiber group 34 does not first have to be separated from the front part 33 of the fiber veil 16. Between two fiber groups 34, there are free zones 64 on the collecting surface 18 as well as on the transporting surface 21, which free zones 64 correspond to a great extent in their function to the cross-stripes 46 already described, and in the present case, however, also suctioned. No single fibers 4 are deposited on these free zones 64. The functioning of the transfer station 23G corresponds to the separating of the fiber groups 34, which also subsequently arrive separately at the spinning line 7.

Figure 8:
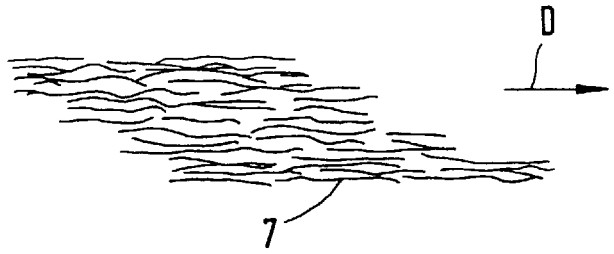
FIG. 8 schematically depicts the overlapping fiber groups arriving at the spinning line.

As can be seen from FIG. 8, the single fiber groups 34 should arrive at the spinning line 7 in such a way that they slightly overlap. A bit of overlapping is absolutely necessary in order that there are no end breaks during yarn 8 formation.

Figure 9:
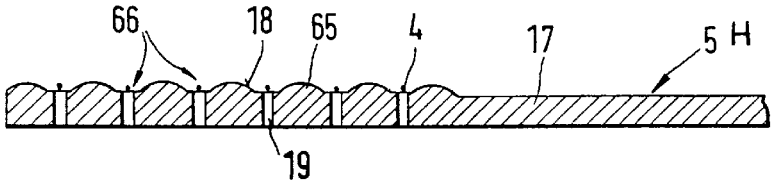
FIG. 9 is an axial section of a transport device comprising the collecting surface, constructed according to a preferred embodiment of the present invention.

As described below, the single fibers 4 can also be fed to the transfer station 23 in the form of fiber columns. This is made possible, for example, by means of a first transport structure 5H, designed as shown in FIG. 9. This shows a transport disc 17 comprising a running ring 65, which comprises a perforation 19. The running ring 65 is provided with lightly grooved running tracks 66, on the bottom of which the perforation 19 is located and where the single fibers 4 are deposited, which thus from the beginning have a distance to one another which allows for the open end. The running tracks 66 ensure that the single fibers 4 are preferably deposited there.

Figure 10:
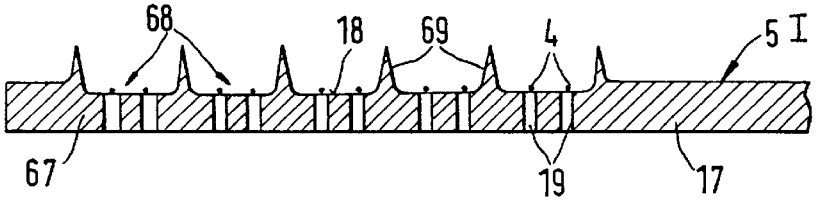
FIG. 10 is a view similar to FIG. 9, showing another embodiment of the present invention.

FIG. 10 shows a similar example of a first transport structure 5I, in which a transport disc 17 has a somewhat differently designed running ring 67. The individual recessed running tracks 68 are separated from one another by means of a type of dividing wall 69. The perforation 19 is again located in the bottom of the running tracks 68, where the single fibers 4 are deposited to a great extent separated from one another. The higher the tips of the dividing walls 69 are, the more certain that the single fibers 4 are deposited only in the running tracks 68.

Figure 11:
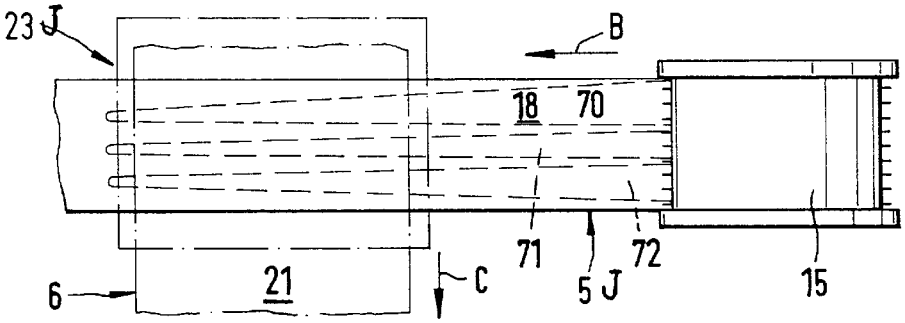
FIG. 11 is a schematic view which shows formation of fiber columns on the collecting surface, according to a preferred embodiment of the present invention.

In the embodiment of the present invention according to FIG. 11, three slivers 2, for example, are fed, to which three separate suction areas 70,71 and 72 are arranged for the collecting surface 18 of the first transport structure 5J. The suction areas 70,71 and 72 each taper in transport direction B. The collecting surface 18 is thus continuously perforated along its width, but is not continuously suctioned, so that in the present case three fiber columns form. The interruption in the suction can be achieved by means of wedge-shaped suction inserts. The broken lines show the range of each of the suction areas 70,71,72.

By means of such suction areas 70,71 and 72, the first very wide fiber streams taper more and more. The single fibers 4 are driven together and condensed in lateral direction. This is in certain circumstances advantageous, as, due to the gentle driving together of the fibers, the orientation of the single fibers 4 is further improved. The orientation of a single fiber 4, which at the start is disposed slightly slanted, can thus be improved before it arrives at the transfer station 23J. It is, of course, self-evident, that care must be taken that the distances between the single fibers 4 permit a reliable open end.

In practice it is generally sufficient when only two suction areas are provided.

Figure 12:
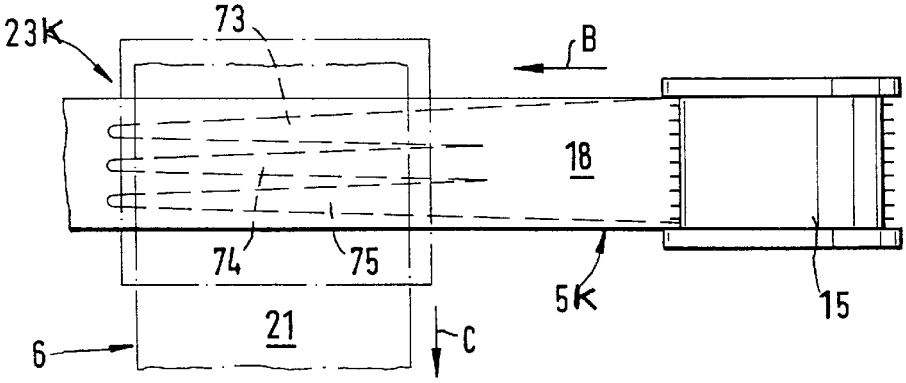
FIG. 12 is a view similar to FIG. 11, showing another embodiment of the present invention.

In the embodiment of the present invention as shown in FIG. 12, the fiber veil 16 is at first disposed in its entire 15 width onto the collecting surface 18 of collecting structure 5K, which, for this purpose, is continuously suctioned. The division into individual fiber columns takes place here just before the transfer station 23K is reached, as can be seen by means of the three suction areas 73,74 and 75. Here also are the wedge-shaped inserts (not shown), so that the suction air stream is partially cut off. The single fibers 4 strive to reach those places where the suction is strongest.

It is therefore not necessary to generate a plurality of fiber columns already in the area of the opening roller 15, rather it is also possible to divide a wide sliver stream later into a plurality of fiber columns. The single fibers 4 are thus condensed in lateral direction, which can be advantageous for their transfer onto the transporting surface 21. By means of the formation of the fiber columns, the orientation of the single fibers 4 may be improved, in that they are twisted somewhat together.

Figure 13:
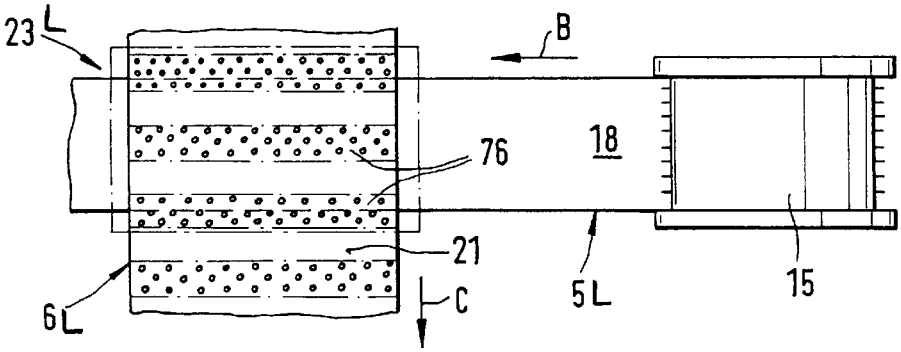
FIG. 13 is a view similar to FIG. 11, showing another embodiment of the present invention with a transporting surface comprising perforated strips.

FIG. 13 shows that also the second transport structure 6L can be designed with breaks, as can be seen by means of the perforated strips 76. Thus the areas which generate adherence are disposed transversely in accordance with the desired fiber orientation, whereby the single fibers 4 may be better aligned parallel to the spinning line 7.

Figure 14:
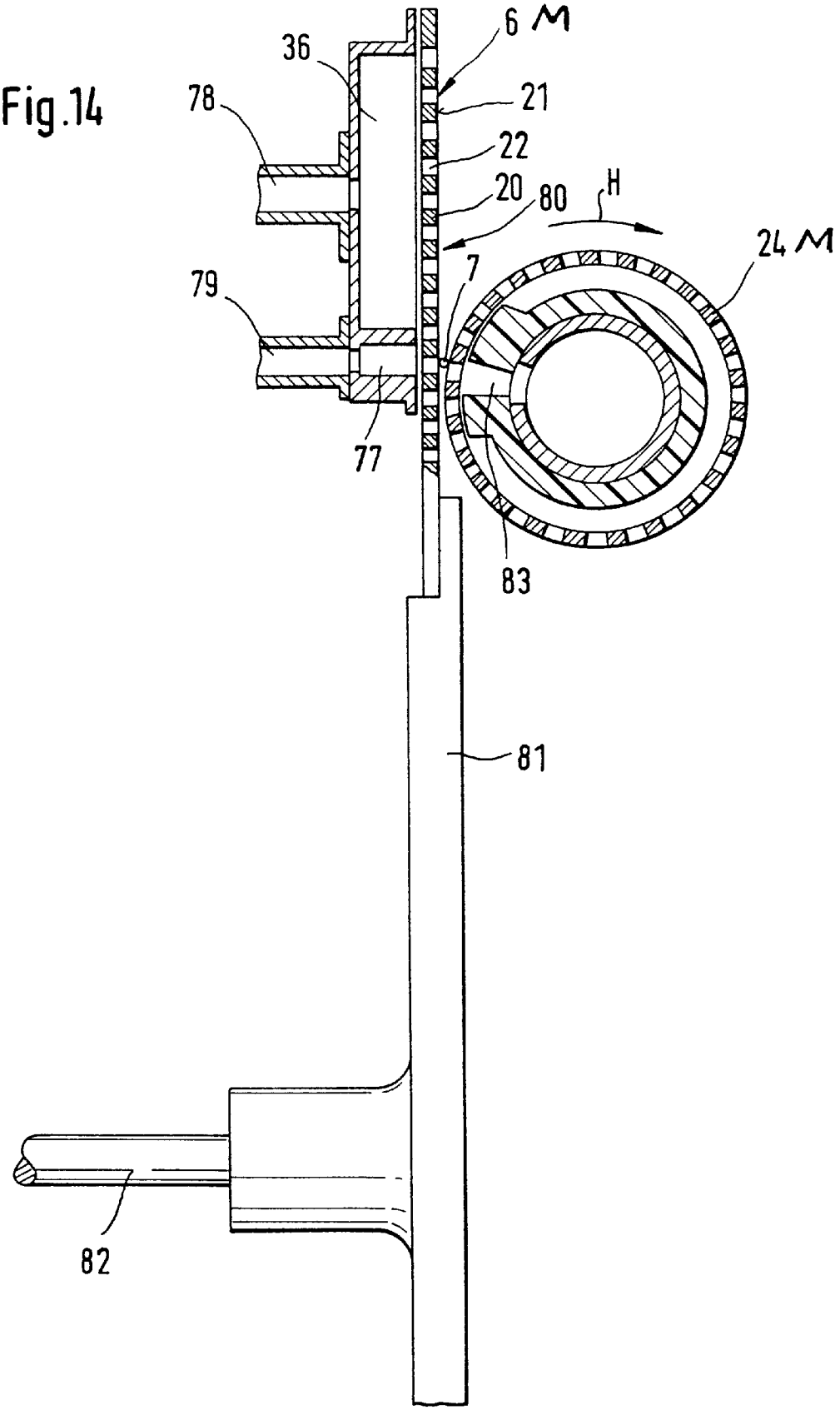
FIG. 14 is a schematic enlarged view of an area of the spinning line for an arrangement and process according to preferred embodiments of the present invention.

FIG. 14 shows the area of the spinning line 7, which is located in the wedge-shaped gap, created by the twist roller 24 and the transporting surface 21. The perforation 22 of the second transport structure 6M and the respective suction device 36, which is connected to a vacuum conduct 78, can be seen.

The transporting disc 20 which forms the second transport structure 6M comprises a perforated ring 80, which consists of a pierced disc measuring 0.7 mm to 1.2 mm in thickness. This is placed on an aluminum base body 81, which is disposed by means of its hub on a rotating shaft 82. When the perforated ring 80 is worn down, for example by means of wear of a coating, the entire transport disk 20 does not have to be replaced, but rather only the thin perforated ring 80.

The suction device 36 of the transporting surface 21 for one is located on the reverse side of the perforated ring 80, as is an independent spinning line suction 77, which is located specially arranged on the spinning line 7 and connected to a vacuum conduct 79. The suction action is increased at that point where the actual twist impartation of the yarn 8 takes place. The suction device 36 thus ensures the transport of the single fibers 4 to the spinning line 7, the spinning line suction 77 ensuring the twist. Both suction devices are adjustable with regard to their positions.

The twist roller 24M, which moves out of the wedge-shaped gap in accordance to the rotation direction H, is also perforated on its circumferential surface and comprises in its interior a suction slit 83, which is directed at the spinning line 7. It is important according to certain contemplated embodiments that the suction slit 83 and the spinning line suction 77, which are disposed opposite one another, are adjustable in relation to one another.

Figure 15:
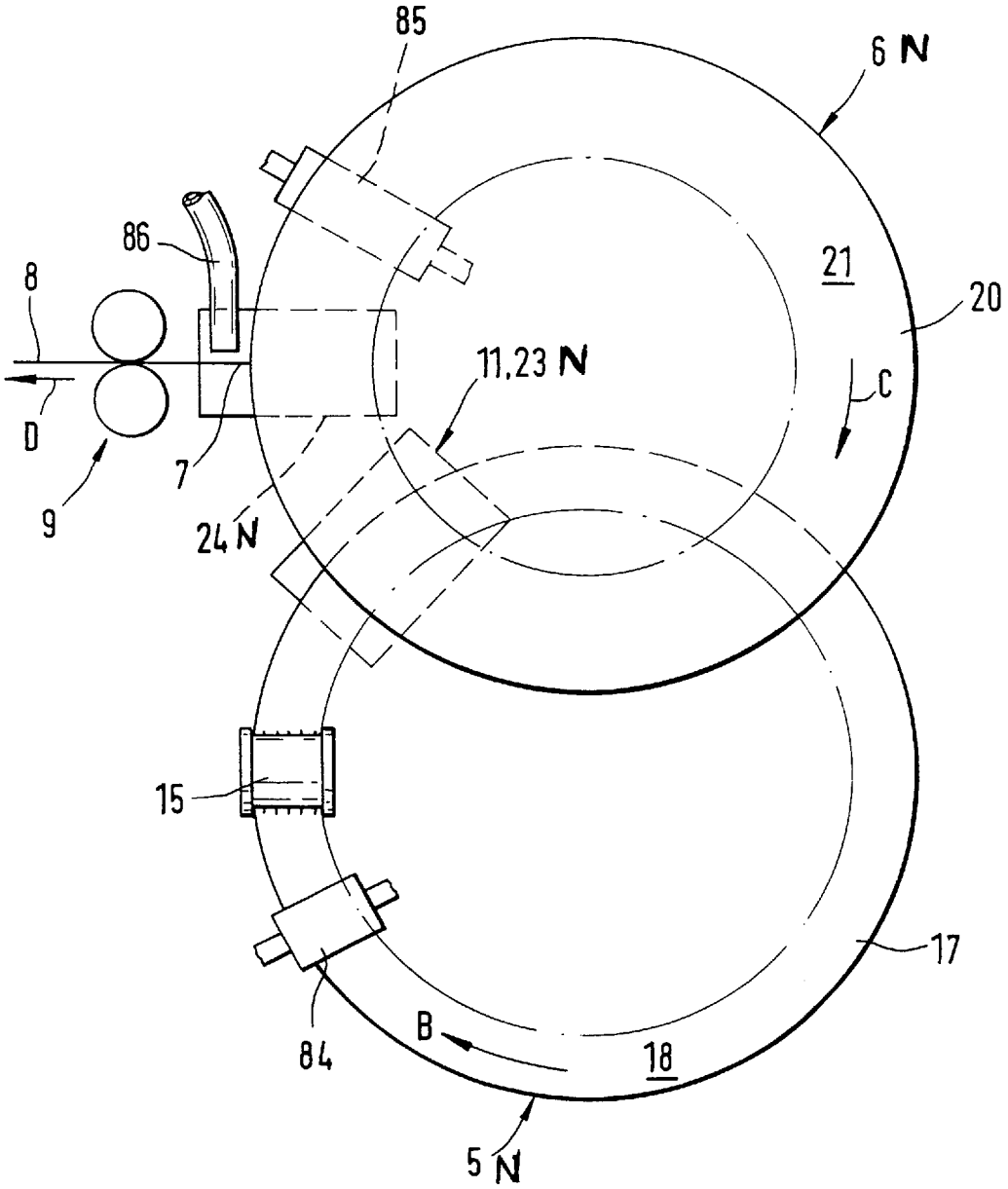
FIG. 15 is a view similar to FIG. 1, showing an embodiment wherein cleaning elements are provided in those areas of the collecting surface not guiding fibers, and in the transporting surface.

The embodiment of the present invention shown in FIG. 15 corresponds to a great extent, with the exception of some omitted components, to FIG. 1, so that a repeat description is superfluous. What is different in this embodiment of the present invention is that in those areas of the collecting surface 18 and the transporting surface 21 which are not fiber-guiding, cleaning elements 84 and 85 in the form of cleaning rollers or similar structure are provided. This type of cleaning element 84 and 85 can be applied everywhere where the transporting structures 5N and 6N have no technical function as regards spinning. Cleaning can alternatively also be realized by means of suction air intakes. The collecting surface 18 and the transporting surface 21 should not only be cleaned of remaining fibers, but it should also be ensured that the perforation remains air-permeable as in practical contemplated embodiments of the type depicted in FIG. 15.

Outside of the transporting surface 21, a suction pipe 86 is arranged at the twist roller 24N in the area of the spinning line 7, as is the case in principle with ring spinning machines downstream of the drafting units. When a yarn 8 breaks, the fibers arising out of this on the spinning line 7 are suctioned off, so that piecing is possible and spinning can begin again.

Figure 16:
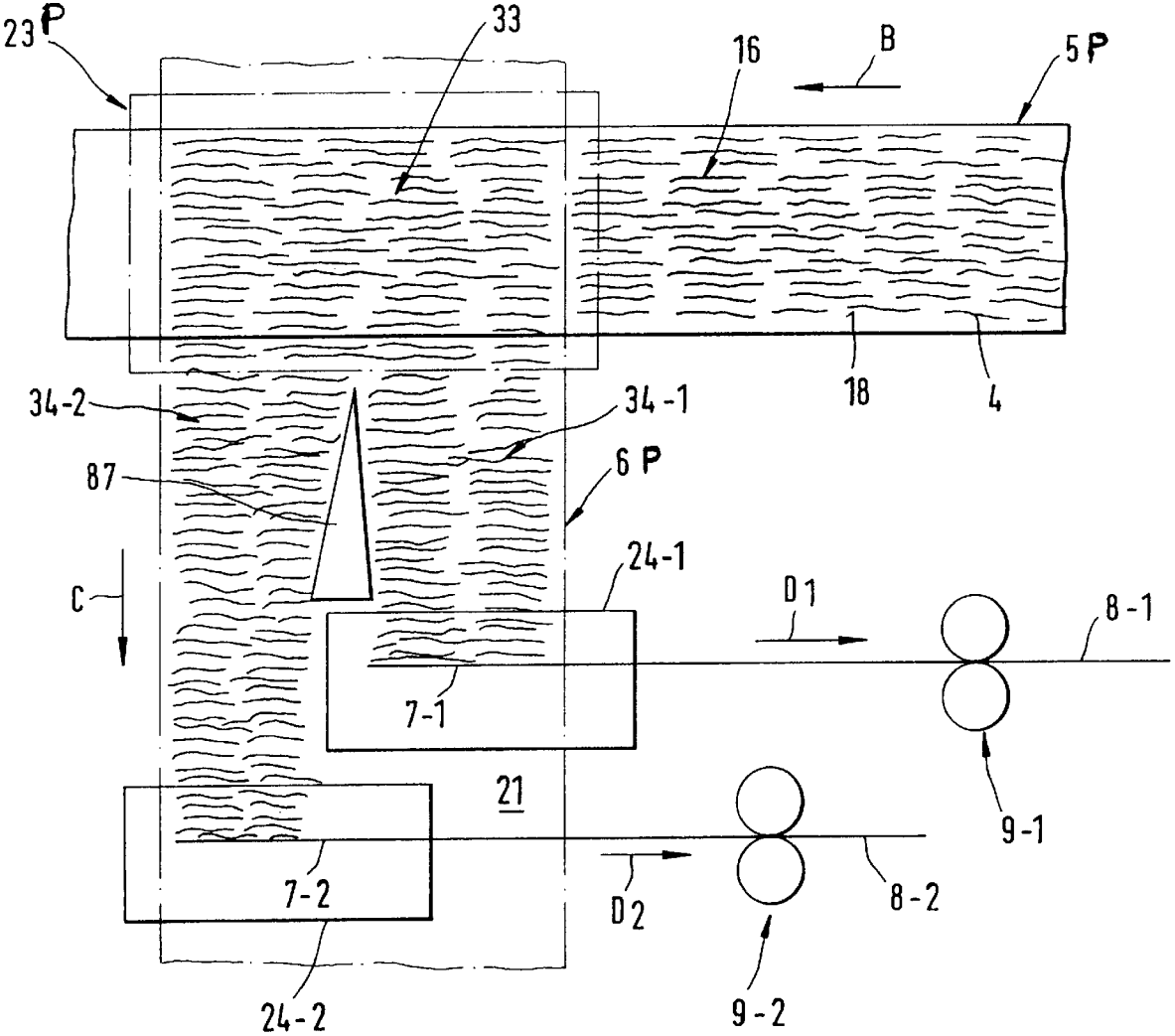
FIG. 16 is a schematic view depicting so-called double spinning station, constructed according to preferred embodiments of the present invention.

The embodiment of the present invention according to FIG. 16 is similar to that of FIG. 2, in which the first transport structure 5P feeds the single fibers 4 in the form of a fiber veil 16, which is disposed on a collecting surface 18, in transport direction B to a transfer station 23P denoted by a dot-dash line. Here the front part 33 of the fiber veil 16, in the form of a fiber group 34, is transferred to a second transport structure 6P, moving transversely to the first in transport direction C, to a transporting surface 21. Again, when here transport belts have been shown for representational reasons, it is, of course, possible that alternatively transport discs are used.

In this embodiment of the present invention, a so-called double spinning point is involved. Two twist rollers 24-1 and 24-2 can be operated, so that there are two spinning lines 7-1 and 7-2. This results in the formation of two yarns 8-1 and 8-2, which are withdrawn by a withdrawal device 9-1 or 9-2 respectively in withdrawal direction D1 or D2.

A wedge 87 is arranged at the suction device of the transporting surface 21, which wedge 87 divides the fiber group 34 in two subgroups 34-1 and 34-2. This division does not occur mechanically, but rather in that there, where the wedge 87 is located, the suction action is prevented.

Figure 17:
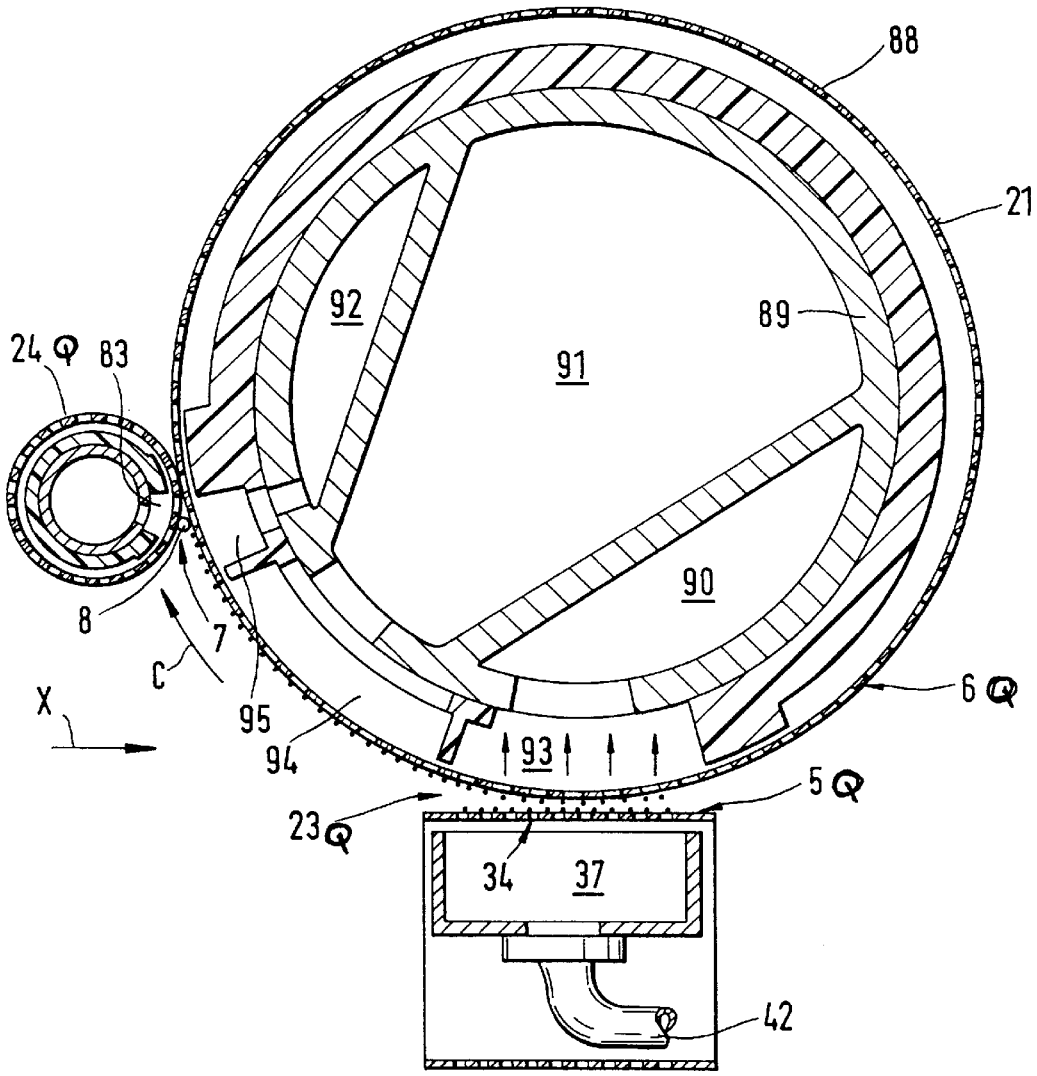
FIG. 17 is a cross sectional view of an arrangement constructed according to a preferred embodiment of the present invention, in which the transporting surface is arranged on a sieve drum having a large diameter.
Figure 18:
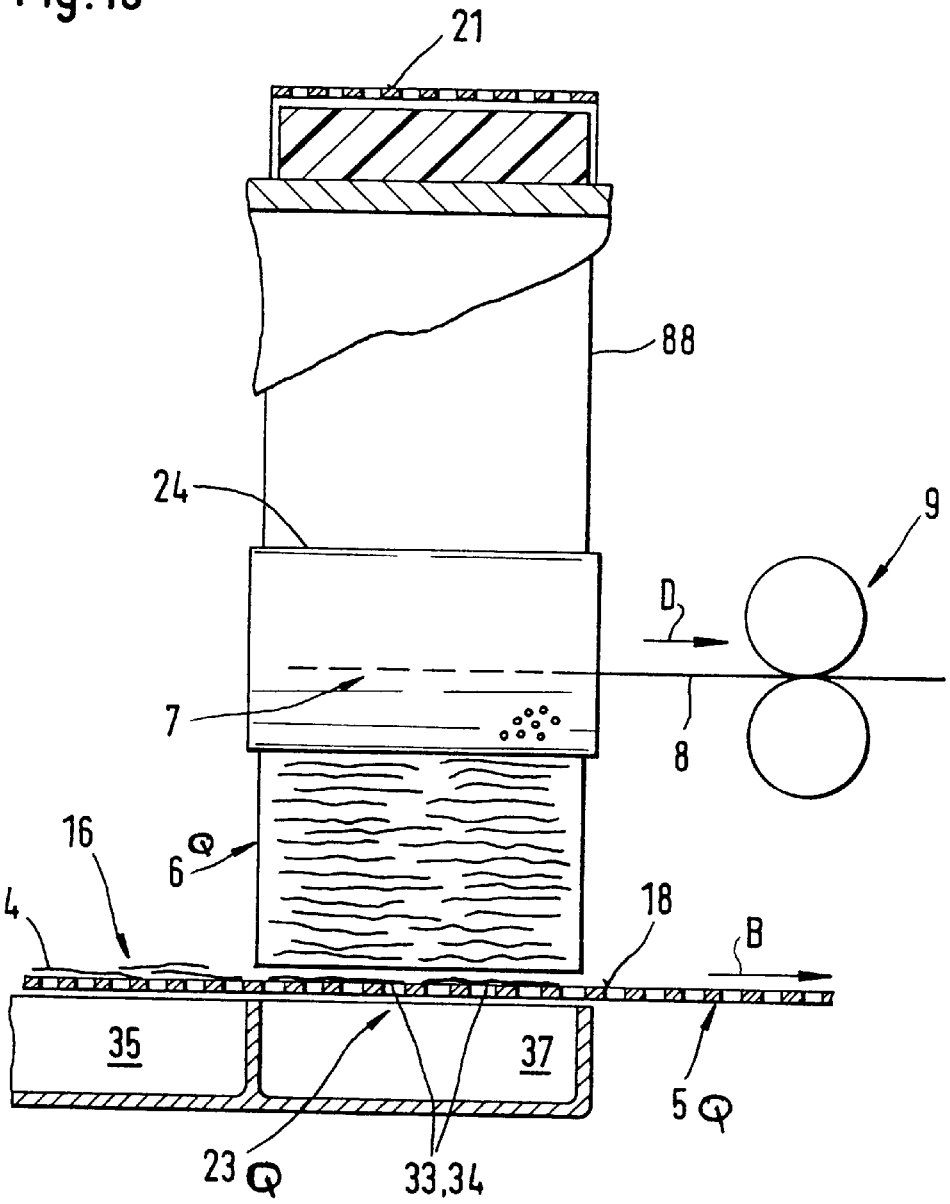
FIG. 18 is a part sectional view taken in arrow direction X of FIG. 17.

In the embodiment of the present invention as shown in FIGS. 17 and 18, the second transport structure 6Q consists of a large sieve drum 88, whose periphery contains the transporting surface 21. The opened single fibers 4 come from an opening roller in the form of a wide fiber veil 16 and are transported by the first transport structure 5Q, which is here again shown as a transport belt and which contains the collecting surface 18, to the area of the transfer station 23Q. The axis of the sieve drum 88 extends aligned identically to the transport belt.

Every time when at the transfer station 23Q the area of the sieve drum 88 is filled up with single fibers 4, a fiber group 34 reaches—in sequence—the transporting surface 21, whereby the single fibers 4 jump over from the collecting surface 18 to the transporting surface 21 in the direction of the denoted arrows. Here, as already explained with respect to the above described embodiments of the present invention, the suction air of the suction chamber 37 is also cut off, so that the suction air of the sieve drum 88 comes into effect. It can be provided that the suction area 93 of the sieve drum 88 arranged at the transfer station 23Q is either continuously suctioned or only intermittently, alternating with the suction chamber 37.

The sieve drum 88 acts together with a twist roller 24, which together with the sieve drum 88 defines the spinning line 7, along which the spun yarn 8 is withdrawn in withdrawal direction D by the withdrawal device 9. The suctioned single fibers 4 at the transfer station 23Q are disposed on the transporting surface 21 parallel to the central line of the sieve drum 88 and thus reach the fiber tip rotating at the spinning line 7 in the desired way, that is, parallel thereto.

It is favorable when the sieve drum 88 has a very large diameter, in order that there is no excessively large distance to the transporting surface 21 from the lateral edges of the collecting surface 18. In order that this geometric disadvantage of a curved transporting surface 21 does not present any problems, it can be provided that the fiber veil 16 be somewhat narrowed on both sides on its way to the transfer station 23Q, as described in principle in FIGS. 11 and 12. If the fiber veil 16 is condensed to circa 20 mm, and the diameter of the sieve drum 88 is sufficiently large, this results in acceptable ratios for the fiber transfer.

The sleeve of the sieve drum 88 is supported on a suction tube 89 in a way not shown, the inside of said suction tube 89 being divided by two cross webs into three suction chambers 90,91 and 92. A suction area 93 is arranged at the suction chamber 90, which suction area 93 belongs to the transfer station 23Q. A suction area 94 is arranged at the suction chamber 91, which suction area 94 serves to transport the transferred fiber groups 34 to the spinning line 7. A narrower suction area 95 is arranged at the suction chamber 92, which suction area 95 acts specifically on the spinning line 7. It is provided that the low pressure of the suction chamber 90 is somewhat higher than the low pressure of the suction chamber 91. The third suction chamber 92, which is responsible for the twist formation, has again a higher low pressure.

In a way not shown, a large sieve drum can, of course, also be provided instead of the transport belt, the periphery of the sieve drum containing the collecting surface 18.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for transferring a fiber veil of open-end fibers from a collecting surface moving in a first direction to a transporting surface moving in a second direction extending at an angle of at least 45° with respect to said first direction, comprising:

pneumatic means disposed to control adherence of said fiber veil to respective ones of said collecting surface and transporting surface, and pneumatic control means for intermittently controlling the pneumatic means to thereby control transfer of portions of said fiber veil from the collecting surface to the transporting surface while maintaining the angular orientation of the fibers in said veil.

2. A process for open-end spinning comprising:

opening at least one sliver to single fibers, forming a fiber veil of parallel ones of the single fibers, transporting the fiber veil to a transfer point on a collecting surface moving in a first direction substantially aligned with the fibers, sequentially transferring portions of the fiber veil to a transporting surface which moves in a second direction transverse to the first direction, while maintaining the angular orientation of the fibers, transporting the portions of the fiber veil on the transporting surface to a spinning line which is aligned with the single fibers, and spinning the single fibers into a yarn at the spinning line, which yarn is withdrawn in its longitudinal direction.

3. A process according to claim 2, wherein the single fibers are held on the collecting surface and on the transporting surface by means of suction.

4. A process according to claim 2, wherein at the transfer point, the transporting surface facing the collecting surface is guided crossways past the collecting surface at a close distance therefrom, whereby the fiber group to be transferred in sequence is raised entirely from the collecting surface and deposited on the transporting surface.

5. A process according to claim 4, wherein during the sequentially transferring portions of the fiber veil from the collecting surface to the transporting surface, the suction of the collecting surface in the area of the transfer point is temporarily cut off.

6. A process according to claim 5, wherein during the cutting off of the suction, the raising of the fiber group from the collecting surface is supported by means of compressed air.

7. A process according to claim 4, wherein the portions of the fiber veil are already divided into fiber groups when being formed during opening of the sliver.

8. A process according to claim 4, wherein the single fibers are additionally drafted during the transfer of the portions of the fiber veil from the collecting surface to the transporting surface.

9. A process according to claim 8, wherein the transporting surface in the area of the spinning line also acts in imparting twist to the forming yarn.

10. A process according to claim 4, wherein the transporting surface in the area of the spinning line also acts in imparting twist to the forming yarn.

11. A process according to claim 4, wherein the transporting surface in the area of the spinning line also acts in imparting twist to the forming yarn.

12. A process according to claim 3, wherein during the sequentially transferring portions of the fiber veil from the collecting surface to the transporting surface, the suction of the collecting surface in the area of the transfer point is temporarily cut off.

13. A process according to claim 12, wherein during the cutting off of the suction, the raising of the fiber group from the collecting surface is supported by means of compressed air.

14. A process according to claim 13, wherein the portions of the fiber veil are already divided into fiber groups when being formed during opening of the sliver.

15. A process according to claim 13,wherein the single fibers are additionally drafted during the transfer of the portions of the fiber veil from the collecting surface to the transporting surface.

16. A process according to claim 13, wherein the transporting surface in the area of the spinning line also acts in imparting twist to the forming yarn.

17. A process according to claim 12,wherein the portions of the fiber veil are already divided into fiber groups when being formed during opening of the sliver.

18. A process according to claim 12, wherein the single fibers are additionally drafted during the transfer of the portions of the fiber veil from the collecting surface to the transporting surface.

19. A process according to claim 12, wherein the transporting surface in the area of the spinning line also acts in imparting twist to the forming yarn.

20. A process according to claim 3, wherein the portions of the fiber veil are already divided into fiber groups when being formed during opening of the sliver.

21. A process according to claim 3, wherein the transporting surface in the area of the spinning line also acts in imparting twist to the forming yarn.

22. A process according to claim 2, wherein the portions of the fiber veil are already divided into fiber groups when being formed during opening of the sliver.

23. A process according to claim 22,wherein the single fibers are additionally drafted during the transfer of the portions of the fiber veil from the collecting surface to the transporting surface.

24. A process according to claim 22, wherein the transporting surface in the area of the spinning line also acts in imparting twist to the forming yarn.

25. A process according to claim 2, wherein the transporting surface in the area of the spinning line also acts in imparting twist to the forming yarn.

26. A process according to claim 25, wherein the forming yarn is imparted an additional false twist as a protective twist by way of a twist roller.

27. An arrangement for open-end spinning comprising:

an opening device operable to open a fiber sliver to single fibers, a collecting surface operable to transport the fibers as a fiber veil from the opening device to a transfer station with said fibers aligned in a first direction corresponding to a moving direction of the collecting surface, a transport surface movable in a second direction transverse to the first direction and operable to transport the fiber veil in the second direction to a spinning line where the fibers are spun into a yarn and drawn off in a longitudinal direction of the yarn, said spinning line extending substantially transversely to said second direction and aligned with the fibers, and a transfer station for sequentially transferring portions of the fiber veil from the collecting surface to the transporting surface while maintaining the angular orientation of the fibers.

28. An arrangement according to claim 27, wherein the first and second directions are inclined at an angle of between 45° and 90° in the area of the transfer station.

29. An arrangement according to claim 27, wherein the collecting surface and the transport surface are provided on respective transport belts.

30. An arrangement according to claim 27, wherein the collecting surface and the transport surface are provided on respective transport discs.

31. An arrangement according to claim 30, wherein the transport disc containing the collecting surface is also the opening device for opening a sliver to single fibers.

32. An arrangement according to claim 27 wherein the transport surface is provided on a sieve drum having a large diameter.

33. An arrangement according to claim 27, wherein the collecting surface comprises a plurality of perforated tracks extending in the first direction.

34. An arrangement according to claim 33, wherein the perforated tracks are separated from one another by means of dividing walls.

35. An arrangement according to claim 27, wherein the transport surface is wider than the collecting surface.

36. An arrangement according to claim 27, comprising:

a first pneumatic system operable to control adherence of the fiber veil to the collecting surface, a second pneumatic system operable to control adherence of the fiber veil to the transporting surface, and a pneumatic control system operable to intermittently apply fiber veil adhering forces to the collecting surface in an area of the transfer station to thereby facilitate the sequential transferring of the portions of the fiber veil from the collecting surface to the transporting surface.

37. An arrangement according to claim 36, wherein the collecting surface includes perforations opening to a suction device of the first pneumatic system, and wherein the perforations of the collecting surface are interrupted by non-perforated cross stripes, whose distance from each other corresponds to the length of the transfer station.

38. An arrangement according to claim 36, wherein the pneumatic control system includes a controlled star valve arranged at an intermittently acting suction chamber of the first pneumatic system.

39. An arrangement according to claim wherein the distance between the collecting surface and the transport surface in the area of the transfer station lessens in a transport direction of the collecting surface.

40. An arrangement according to claim 27, wherein a twist roller is arranged at the transport surface in the area of the spinning line.

41. An arrangement according to claim 27, wherein a cleaning element is arranged at the collecting surface and the transport surface in a non-fiber guiding area.

42. An arrangement for open-end spinning comprising:

opening means for opening at least one sliver to single fibers, fiber veil forming means for forming a fiber veil of parallel ones of the single fibers, transporting means for transporting the fiber veil to a transfer point on a collecting surface moving in a first direction substantially aligned with the fibers, transfer means for sequentially transferring portions of the fiber veil to a transporting surface which moves in a second direction transverse to the first direction, while maintaining the angular orientation of the fibers, transporting means for transporting the portions of the fiber veil on the transporting surface to a spinning line which is aligned with the single fibers, and spinning means for spinning the single fibers into a yarn at the spinning line, which yarn is withdrawn in its longitudinal direction.

43. An arrangement according to claim 42, comprising suction means for holding the single fibers on the collecting surface and on the transporting surface by means of suction.

44. An arrangement according to claim 43, comprising guiding means at the transfer point for guiding the transporting surface facing the collecting surface crossways past the collecting surface at a close distance therefrom, whereby the fiber group to be transferred in sequence is raised entirely from the collecting surface and deposited on the transporting surface.

45. An arrangement according to claim 44, comprising suction control means such that during the sequenced transfer of a fiber group from the collecting surface to the transporting surface, the suction of the collecting surface in the area of the transfer point is temporarily cut off.

46. An arrangement according to claim 45, wherein during the cutting off of the suction, the raising of the fiber group from the collecting surface is supported by means of compressed air.

47. An arrangement according to claim 42, comprising fiber veil dividing means for already dividing the veil into fiber groups when being formed during opening of the sliver.

48. A process for transferring a fiber veil of open-end fiber from a first surface moving in a first direction to a second surface moving in a second direction extending at an angle with respect to said first direction comprising:

moving said first surface to transport said fiber veil of said open-end fiber in said first direction, moving said second surface in said second direction transverse to said first direction, controlling adherence of said fiber veil to said first moving surface with said fibers aligned with the first direction, and transferring said fiber veil from the first moving surface to the second moving surface while maintaining the angular orientation of th fibers in said veil to extend in said first direction.

49. A process according to claim 48, wherein said angle is at least 45°.

50. A process according to claim 46, wherein said controlling adherence includes applying pneumatic forces to the fiber veil.

51. A process according to claim 50, wherein said transferring includes intermittently interrupting the pneumatic forces acting on the fiber veil on the first surface.

* * * * *